US005417796A

United States Patent [19]

Lovelace et al.

[11] Patent Number: 5,417,796

[45] Date of Patent: May 23, 1995

[54] AUTOMATIC DISPENSING DEVICE FOR MASKING PAPER AND TAPE

[76] Inventors: Randy L. Lovelace, 3762 N. Dearborn Rd., West Harrison, Ind. 47060; George Spector, 233 Broadway Rm. 702, New York, N.Y. 10279

[21] Appl. No.: 69,215

[22] Filed: Jun. 2, 1993

[51] Int. Cl.[6] ..... B32B 31/18

[52] U.S. Cl. ..... 156/554; 83/157; 83/167; 83/649

[58] Field of Search ..... 83/157, 167, 203, 205, 83/649, 650, 922, 949; 156/554

[56] References Cited

U.S. PATENT DOCUMENTS

| | | | |
|---|---|---|---|
| 1,963,666 | 6/1934 | McCarthy et al. | 156/554 |
| 3,152,032 | 10/1964 | Waltz | 156/554 |
| 3,361,021 | 1/1968 | Toth | 83/649 X |
| 4,052,248 | 10/1977 | Hunter | 156/554 X |
| 4,470,870 | 9/1984 | Driscoll et al. | 156/554 X |
| 4,572,761 | 2/1986 | Phillips, Sr. | 156/554 X |
| 4,738,176 | 4/1988 | Cassia | 83/649 X |
| 5,174,518 | 12/1992 | Hongo et al. | 83/649 X |

FOREIGN PATENT DOCUMENTS

| | | | |
|---|---|---|---|
| 0385152 | 9/1990 | European Pat. Off. | 83/157 |

*Primary Examiner*—Eugenia Jones

[57] ABSTRACT

An automatic dispensing device for masking paper and tape is provided to simultaneously dispense through a slot in a front wall of a cabinet, masking paper from a roll and masking tape from a roll. The masking tape is affixed to the masking paper in a position which overlaps a longitudinal edge of the masking paper.

1 Claim, 1 Drawing Sheet

AUTOMATIC DISPENSING DEVICE FOR MASKING PAPER AND TAPE

BACKGROUND OF THE INVENTION

The instant invention relates generally to hand-held masking machines and more specifically it relates to an automatic dispensing device for masking paper and tape, which provides a mechanism which will automatically supply a predetermined length of masking tape over one edge of a sheet of masking paper.

There are available various conventional hand-held masking machines which do not provide the novel improvements of the invention herein disclosed.

SUMMARY OF THE INVENTION

A primary object of the present invention is to provide an automatic dispensing device for masking paper and tape that will overcome the shortcomings of the prior art devices.

Another object is to provide an automatic dispensing device for masking paper and tape that will automatically supply a predetermined length of a strip of masking tape over one edge of a sheet of masking paper, which may be temporarily attached to a surface for protecting that surface.

An additional object is to provide an automatic dispensing device for masking paper and tape that will automatically cut the masking paper with the strip of masking tape at the predetermined length desired.

A further object is to provide an automatic dispensing device for masking paper and tape that is simple and easy to use.

A still further object is to provide an automatic dispensing device for masking paper and tape that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
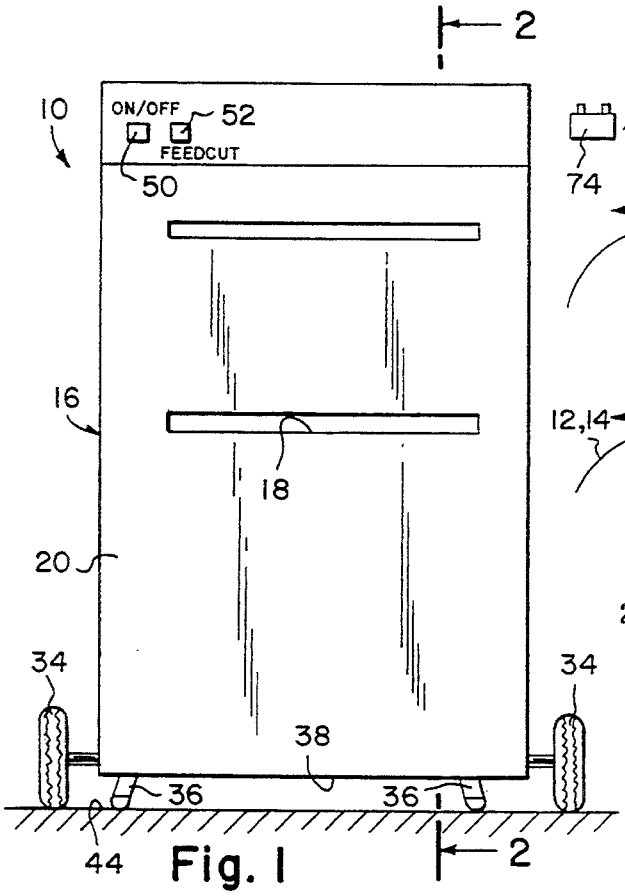
FIG. 1 is a front view of the instant invention.
Figure 2:
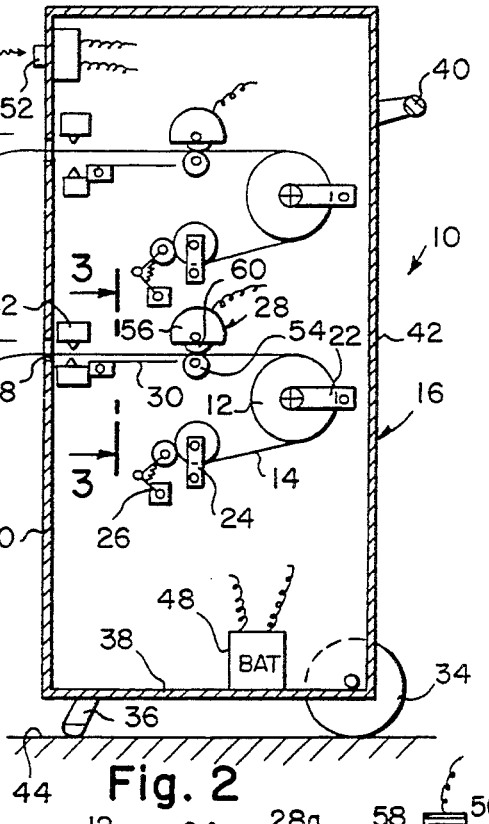
FIG. 2 is a side cross sectional view taken along line 2—2 in FIG. 1, showing the internal mechanism therein.

Turning now descriptively to the drawings, in which similar reference characters denote similar elements throughout the several views, FIGS. 1 and 2 illustrate an automatic dispensing device 10 for masking paper 12 and tape 14, which consists of an elongate cabinet 16 having a horizontal slot 18 in a front wall 20. Two identical mechanisms are shown, but only the lower one is described herein. A first bracket 22 is mounted within the cabinet 16, to support a roll of masking paper 12. A second bracket 24 is mounted within the cabinet 16, to support a roll of masking tape 14. A tension wheel and spring assembly 26 is in engagement with the roll of masking tape 14 to reduce slack thereof. An apparatus 28 is for driving the masking tape 14 into an overlapping engagement with an edge of the masking paper 12. A tray 30 is mounted within the cabinet 16, so as to guide the masking paper 12 with the masking tape 14 towards the horizontal slot 18 in the front wall 20. A cutter 32 is located within the cabinet 16 between the tray 30 and the horizontal slot 18 in the front wall 20, so as to cut off a predetermined length of a withdrawn segment of the masking paper 12 with the masking tape 14.

A pair of wheels 34 are rotatively mounted to a lower rear corner of the cabinet 16. A pair of squaring legs 36 are mounted under a forward edge of a bottom wall 38 of the cabinet 16. A handle 40 is mounted to an upper portion of a rear wall 42 of the cabinet 16. A person can grip the handle 40 and pull the device 10 with the wheels, traveling along a horizontal surface 44 to different locations.

Figure 6:
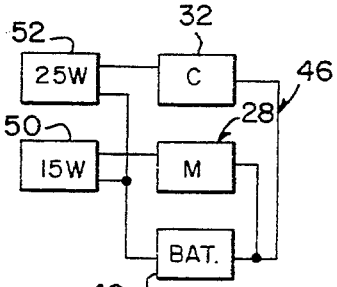
FIG. 6 is a simplified block diagram of the electrical circuit.

An electronic circuit 46, best shown in FIG. 6, contains a battery 48 for supplying power to the driving apparatus 28 and the cutter 32. A first switch 50 is located on the front wall 20 of the cabinet 16, the battery 48 and the driving apparatus 28, for turning the driving apparatus 28 on and off. A second switch 52 is located on the front wall 20 of the cabinet 16 and is electrically connected between the battery 48 and the cutter 32, for turning the cutter 32 on and off.

Figure 3:
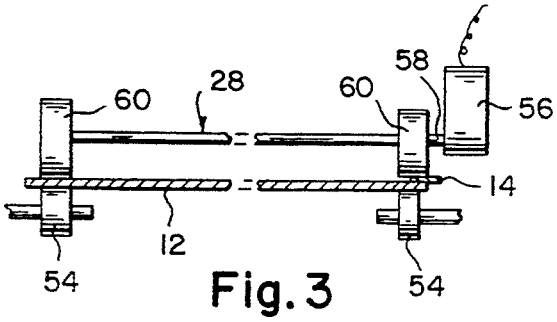
FIG. 3 is an enlarged cross sectional view taken along line 3—3 in FIG. 2, showing a first type of motor feed.

The driving apparatus 38, as shown in FIGS. 2 and 3, includes a pair of idler wheels 54, spaced apart and rotatively mounted to the cabinet 16, so as to engage with an underside of the masking paper 12 at opposite edges thereof. An electric motor 56 is provided, having a drive shaft 58 extending therefrom. A pair of drive wheels 60 are spaced apart and rotatively mounted to the drive shaft 58, so as to engage with a top side of the masking paper 12 at opposite edges thereof. One drive wheel 60 makes contact with the masking tape 14.

Figure 3A:
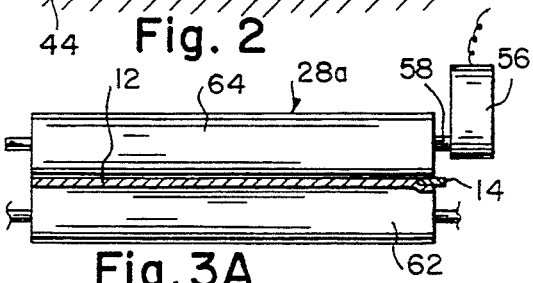
FIG. 3A is an enlarged cross sectional view similar to FIG. 3, showing a second type of motor feed.

A modified driving apparatus **28*a* is shown in FIG. 3A and includes an idler roller 62, rotatively mounted to the cabinet 16, so as to engage with an underside of the masking paper 12, between opposite edges thereof. The electric motor 56 also has the drive shaft 58 extending therefrom. A drive roller 64 is rotatively mounted to the drive shaft 58, so as to engage with a top side of the masking paper 12 and the masking tape 14**, between opposite edges thereof.

Figure 4:
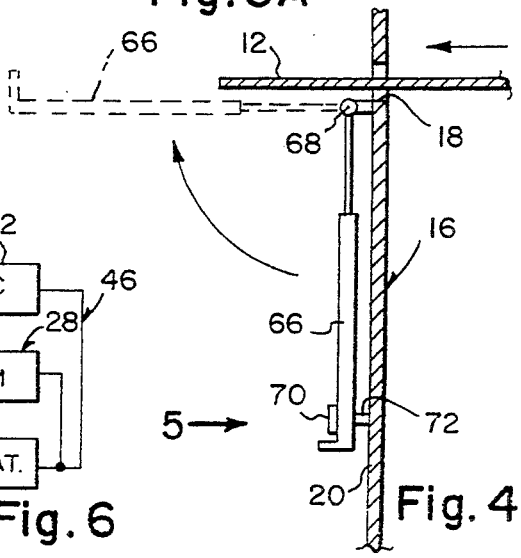
FIG. 4 is a partial side cross sectional view of a modification that includes a telescopic platform for masking paper retention.
Figure 5:
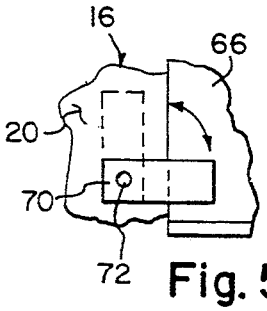
FIG. 5 is a partial front view taken in direction of arrow 5 in FIG. 4, showing the operation of the latch to release the platform.

In FIG. 4, a telescopic platform 66 is provided. A spring hinge 68 is for connecting one end of the telescopic platform 66 to the front wall 20 of the cabinet 16, below the horizontal slot 18. The spring hinge 68 normally biases the telescopic platform 66 into a horizontal position, for retaining thereon the withdrawn segment of the masking paper 12 with the masking tape 14. A latch 70, shown in FIGS. 4 and 5, is pivotally mounted at 72 to the front wall 20 of the cabinet 16, for retaining the telescopic platform 66 in a vertical position when not in use.

A remote control unit 74, as shown in FIG. 2, can be utilized to operate the first switch 50 and second switch 52, from a remote distance from the cabinet 16. The remote control unit 74 can be clipped onto a shirt or held in the hand, then stored away in a compartment within the cabinet 16, when not being used.

OPERATION OF THE INVENTION

To use the automatic dispensing device 10, a person presses the first switch 50 to start feeding the masking paper 12, with the overlapping masking tape 14 thereon through the slot 18 in the front wall 20 of the cabinet 16. After a predetermined length is obtained the first switch 50 is pressed again to stop the feeding. The second switch 52 is then pressed to cut off the masking paper 12 with the overlapping masking tape 14. If the device 10 is used with the telescopic platform 66, the masking paper with the overlapping masking tape 14 will be retained thereon.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An automatic dispensing device for masking paper and tape which comprises:

a) an elongate cabinet having a horizontal slot in a front wall;

b) a first bracket mounted within said cabinet to support a roll of masking paper having a top side;

c) a second bracket mounted within said cabinet to support a roll of masking tape;

d) a tension wheel and spring assembly in engagement with said roll of masking tape to reduce slack thereof;

e) driving means forward of said masking paper roll for driving said masking tape and said paper in overlapping attached relationship;

f) a tray aligned with said slot mounted within said cabinet beneath said paper forward of said driving means so as to guide said masking paper with said attached masking tape towards said horizontal slot in said front wall;

g) a cutter located within said cabinet between said tray and said horizontal slot in said front wall as to cut off a segment of masking paper with said attached tape; wherein said driving means includes:

h) an idler roller rotatively mounted on said cabinet, engaging an underside of said masking paper;

i) an electric motor having a drive shaft extending therefrom;

j) a drive roller connected to said drive shaft, engaging both the top side of said masking paper and said masking tape to drive said tape and paper forward towards said slot while guided by said tray;

k) a telescopic platform mounted externally on said cabinet;

l) a spring hinge for connecting one end of said telescopic platform to said front wall of said cabinet below said horizontal slot, said spring hinge normally biases said telescopic platform into a horizontal position beneath said segment dispensed outward of said cabinet for retaining said segment thereon;

m) a latch pivotally mounted on said front wall of said cabinet for retaining said telescopic platform in a vertical position when not in use.

* * * * *